US007870748B2

(12) United States Patent
Byrne

(10) Patent No.: US 7,870,748 B2
(45) Date of Patent: Jan. 18, 2011

(54) METHOD FOR CONTROLLED RATE FREEZING AND LONG TERM CRYOGENIC STORAGE

(76) Inventor: Kathleen H. Byrne, 243 Lawyers Rd., Vienna, VA (US) 22180

( * ) Notice: Subject to any disclaimer, the term of this patent is extended or adjusted under 35 U.S.C. 154(b) by 793 days.

(21) Appl. No.: 11/361,265

(22) Filed: Feb. 21, 2006

(65) Prior Publication Data

US 2006/0196193 A1 Sep. 7, 2006

Related U.S. Application Data

(60) Provisional application No. 60/656,793, filed on Feb. 25, 2005.

(51) Int. Cl.
*F25D 25/00* (2006.01)

(52) U.S. Cl. ..... 62/62; 62/371; 62/457.5

(58) Field of Classification Search ..... 62/62, 62/371, 457.1, 457.5

See application file for complete search history.

(56) References Cited

U.S. PATENT DOCUMENTS 1,763,461 A 6/1930 Fowler
3,379,315 A 4/1968 Broadwin
4,328,676 A * 5/1982 Reed ..... 62/3.62
4,665,713 A 5/1987 Delatte
4,671,405 A * 6/1987 Hagan ..... 206/139
4,771,900 A 9/1988 Leoncavallo et al.
4,898,278 A 2/1990 Leoncavallo et al.
5,226,715 A 7/1993 Delatte
5,685,438 A 11/1997 Emanuel et al.
5,950,832 A 9/1999 Pearlman
6,141,975 A * 11/2000 Tatsumi ..... 62/62
6,640,981 B2 11/2003 LaFond et al.

* cited by examiner

*Primary Examiner*—Melvin Jones
(74) *Attorney, Agent, or Firm*—Lisa J. Allen

(57) ABSTRACT

A containment apparatus (10) having a floor wall (12) with four side walls (16) extending therefrom and an opening (13) at the top. Each of the side walls (16) and the floor wall (12) include apertures (20) defined within to allow air to flow freely throughout the containment apparatus. A lid (18) may be provided to place on the containment apparatus to cover the opening (13). A divider (21) made of interlocking wall strips (23) that connect to define a plurality of separate compartments (25). Each interlocking wall strip (23) having multiple apertures (20) defined within to allow for free airflow around, through and between each compartment (25). An alternative embodiment of the divider (31) is comprised of a molded material such as plastic for holding thermosensitive product vials. The alternative divider (31) having a plurality of aligned wells (39). Each well (39) being adapted to support one thermosensitive product vial.

6 Claims, 7 Drawing Sheets

METHOD FOR CONTROLLED RATE FREEZING AND LONG TERM CRYOGENIC STORAGE

CROSS-REFERENCE TO RELATED APPLICATION

This application claims the benefit of Provisional Patent Application Ser. No. 60/656,793 filed 2005 Feb. 23.

FIELD OF THE INVENTION

The present invention relates generally to the field of cryogenic storage of thermosensitive products, and more specifically to a multi-purpose containment apparatus for storing thermosensitive products, that is capable of meeting the standards required for cryogenic storage freezers while providing the free airflow necessary for controlled rate freezing.

BACKGROUND OF THE INVENTION

Almost all laboratories store thermosensitive products such as blood, tissues, cells, bacteria, etc., in ml vials, that fit into an industry standard storage container. The container, in turn, fits into a standard freezer rack, set by industry standards, designed to accommodate the maximum amount of storage containers, while fitting the internal dimensions of the cryogenic storage freezer. Such cryogenic containers are typically in the form of a simple cardboard or plastic box that is suitable for long term storage at ultra-low temperatures.

Further, the number of vials that can be stored within the storage container is standardized within the industry. Examples of some industry standard configurations for the number of vials include: 81 vials (in a 9×9 configuration), 100 vials (in a 10×10 configuration), and 64 vials (in an 8×8 configuration.) Typically, vials are placed in the standard industry storage container, which is placed in the cryogenic freezer, usually a −80 C freezer or a liquid nitrogen (LN2) freezer for freezing and storage.

Much energy is required to maintain the thermosensitive products at cryogenic temperatures. Accordingly, cryogenic storage freezers are compact in design for energy and spatial efficiency. Each cryogenic freezer has a finite amount of space and little tolerance for varying sizes of containers within. Much thought and experimentation has gone, and goes, into determining the optimal numbers and configuration of sample vials etc for acceptable freezing of the most vials for the least energy cost.

Much research has shown that using a controlled rate freezer prior to placing thermosensitive products in a final storage freezer is preferred because it is better for the samples. Bringing the temperature of the samples down gradually results in less shock to the specimens, thus resulting in increased cryoprotection.

However, there is much resistance in the industry to incorporate controlled rate freezing because the standard cryogenic storage containers cannot be used in the controlled rate freezing process. This is because effective controlled rate freezing requires free air flow around and between the vials, which the current cryogenic storage containers do not allow. A more open configuration is necessary for sufficient airflow during controlled rate freezing.

Several devices are typically used to secure the sample vials during controlled rate freezing. For example, a wire rack can be used, and a rounded rack consisting of a series of disks to hold samples is sometimes used. However, these and other controlled rate freezing apparatus for securing the sample vials are unsuitable for use in cryogenic freezing storage because they are not designed or configured to meet the standards required for cryogenic storage.

For example, the existing racks used in controlled rate freezers are in a non-industry standard configuration. Examples of such non-industry standard configurations include a 12×16 configuration, a 6×10 configuration, cane or circular configuration, to name a few, so that technicians, scientists, or other parties must perform a multi-step process to incorporate the advantages of controlled rate freezing.

The thermosensitive product vials typically must be taken out of a standard configuration container and placed in a non-standard configuration rack or other device, which is placed in the controlled rate freezing apparatus. After the controlled rate freezing process is concluded, the thermosensitive product vials are removed from the controlled rate freezing apparatus, such as the rack or disc. The vials are carefully placed back into a standard configuration storage container and the storage container is placed in a cryogenic freezer for storage. This multi-step process, with the typical transfers of multiple vials, results in increased labor, increased costs, and an increase in the possibility of vial misplacement and harm to the specimens.

The possibility of misplacement or mishandling of one or more of the vials during this process is of particular concern. Careful track of the vial placement must be kept so as not to misplace the thermosensitive products. Vial mix-ups could lead to disastrous consequences. For example, misplaced DNA samples could help set a guilty person free or medical sample mix-ups could lead to an incorrect diagnosis.

Accordingly, there has been a long-felt need in the industry to eliminate the extra steps involved in relocating the thermosensitive product vials between two different containers to obtain the benefit of controlled rate freezing.

DETAILED DESCRIPTION

In accordance with the present invention, there is provided a multi-purpose apparatus designed to reduce or eliminate the multiple step process for controlled rate freezing and cryogenic freezing and storage of thermosensitive products, by providing a standardized containment apparatus capable of meeting the conditions necessary for use in a cryogenic freezer, while also being capable of use in a control-rate freezers.

Embodiments of the multi-purpose containment apparatus and method of use are described herein by way of example only and not by way of limitation.

Turning to the drawings, wherein like reference numbers denote like or corresponding parts throughout the figures, example embodiments of the multi-purpose containment apparatus are shown.

Figure 1:
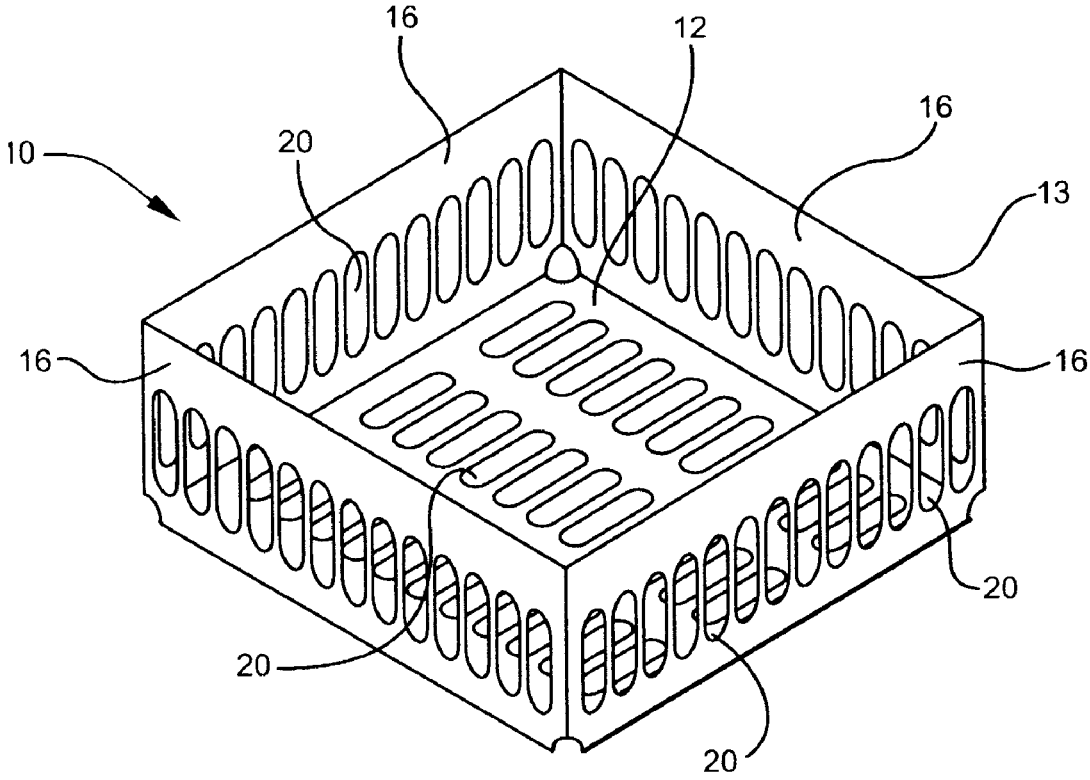
FIG. 1 is a perspective view showing a preferred embodiment of the multi-purpose containment apparatus.

Turning to FIG. 1, a preferred embodiment of the multi-purpose containment apparatus is shown. The containment apparatus 10 is comprised of a floor wall 12 having wall apertures 20 defined within. The apparatus 10 also includes four side walls, denoted 16, having apertures, denoted 20 defined within the side walls 16, extending from the floor 12. Between the side walls 16, an opening 13 is defined opposite the floor wall 12.

The containment apparatus 10 can be made using any suitable materials in the art, including, but not limited to, steel, aluminum, stainless steel, cardboard, a plastic or other resin, or any combination thereof. The containment apparatus can be of any suitable dimensions. In this embodiment, each containment apparatus floor 12 is about 130.175 mm×130.175 mm (5.125" square), and each side wall 16 is about 130.175 mm (5.125") in length and up to 76.2 mm (3") high. Further, the apertures 20 can be of any suitable shape or configuration. The vials can be separated and secured within the apparatus by any suitable means.

Figure 2:
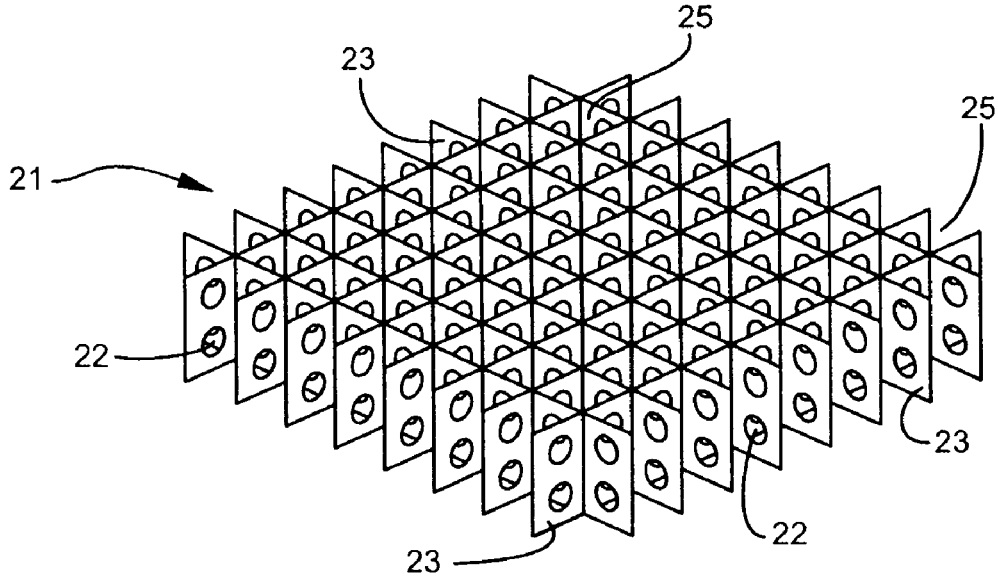
FIG. 2 is a perspective view of the apparatus of FIG. 1, showing an included divider.
Figure 2:
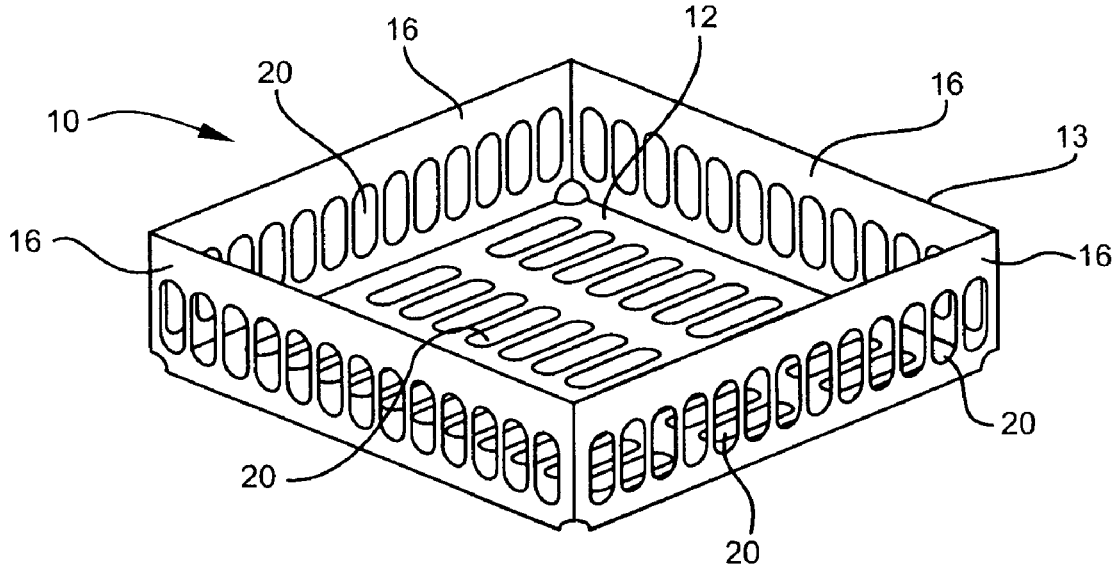

Turning to FIG. 2, the apparatus of FIG. 1 is shown, and separation and individual containment of the vials is achieved by means of a provided divider 21. The divider 21 is placed within the apparatus 10 and vials placed therein. The divider 21 is comprised of a plurality of interlocking wall strips 23, which are transversely connected to define a plurality of smaller compartments 25 as shown. In this embodiment, each wall strip 23 of the divider has divider apertures, denoted 22 defined within to allow for free airflow between thermosensitive products stored in the compartments.

The divider 21 can be made using any suitable materials, including, but not limited to, steel, stainless steel, aluminum, cardboard, a plastic, or other resin, or any suitable combination thereof. The divider 21 can be of any suitable dimensions providing that the divider 21 has dimensions that would allow for placement within containment apparatus 10. The divider 21 herein comprised of interlocking walls strips 23 which are connected to form a plurality of compartments 25 in any suitable configuration in the art such as, but not limited to, an 8×8 configuration, a 9×9 configuration, and a 10×10 configuration. In this embodiment the configuration is a 9×9 configuration to form 81 compartments 25.

Product vials are placed in the divider compartments 25, and the apparatus 10 is placed in a controlled rate freezer 42. The overall design of the apparatus 10, including apertures 20 and, in some cases, the divider 21, allows for free airflow around and between the thermosensitive product vials stored within the apparatus 10. Since the air is free to flow around and between the thermosensitive products, cooling of the products according to specifications is more successful and results in more uniform temperature reduction in the controlled rate freezing process.

Once an appropriate temperature has been reached, the container apparatus 10 is removed from the controlled rate freezer 42 and placed directly in the cryogenic storage freezer 54. Thus the steps of placing the thermosensitive product vials in a non-industry standard container for controlled rate freezing and removing and arranging them in proper order in an industry standard container for storage in the cryogenic freezer 54 are eliminated.

Figure 3:
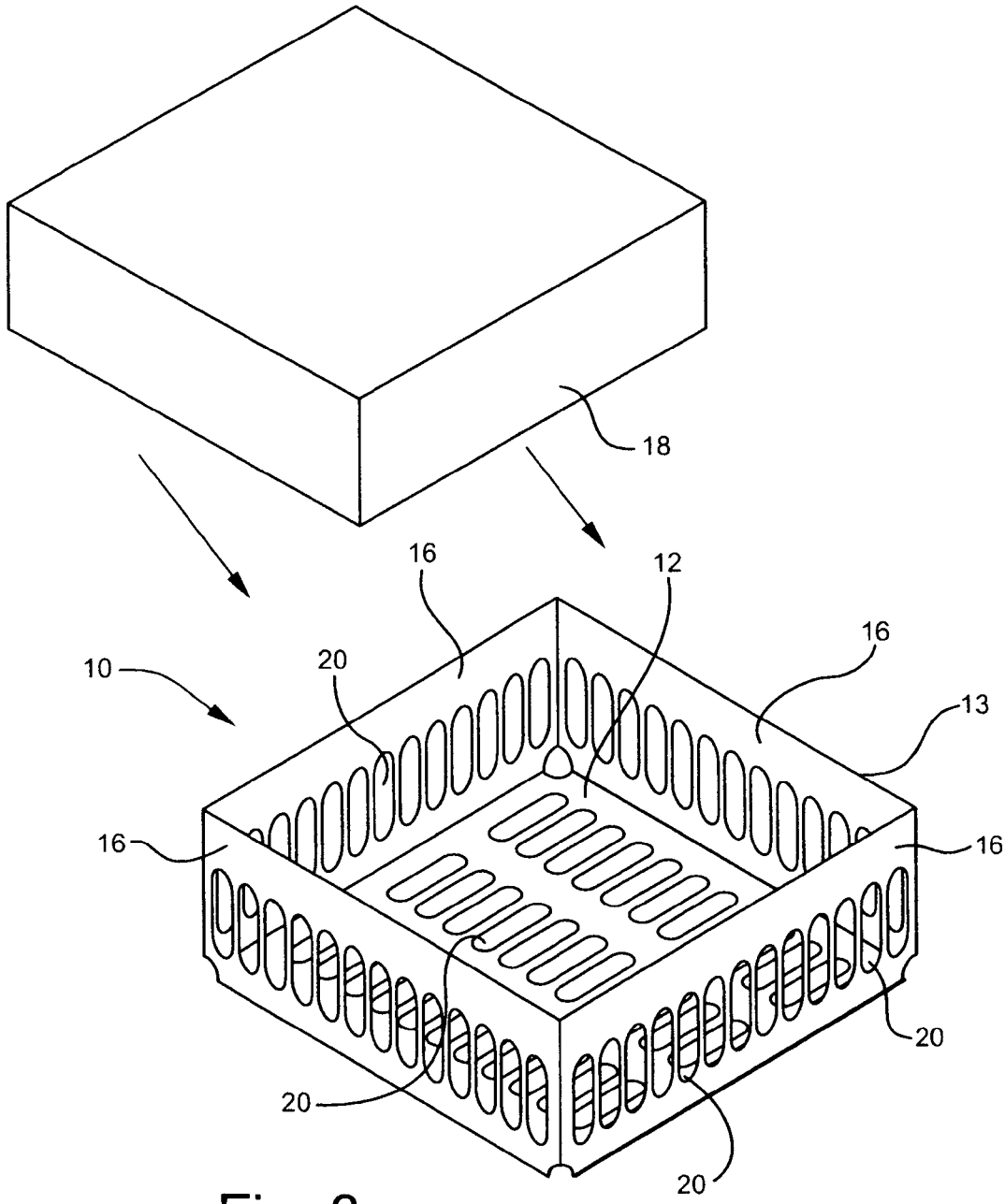
FIG. 3 is a perspective view of the containment apparatus of FIGS. 1-2 showing an included lid.

Turning to FIG. 3, The containment apparatus 10 may also have a lid 18, which can be placed on the opening 13 as shown in FIG. 2. The lid can provide additional protection for the vials during storage, and can be used for labeling a container of vials.

In this embodiment, the lid 18 is about 133.35 mm×133.35 mm (5.25" square). These dimensions are the current industry standard for fitting into the freezer racks. However the lid can be of any suitable dimension. Further, the lid 18 can be constructed of any suitable material or combination of materials, including, but not limited to, those denoted herein for construction of the apparatus 10.

Figure 4:
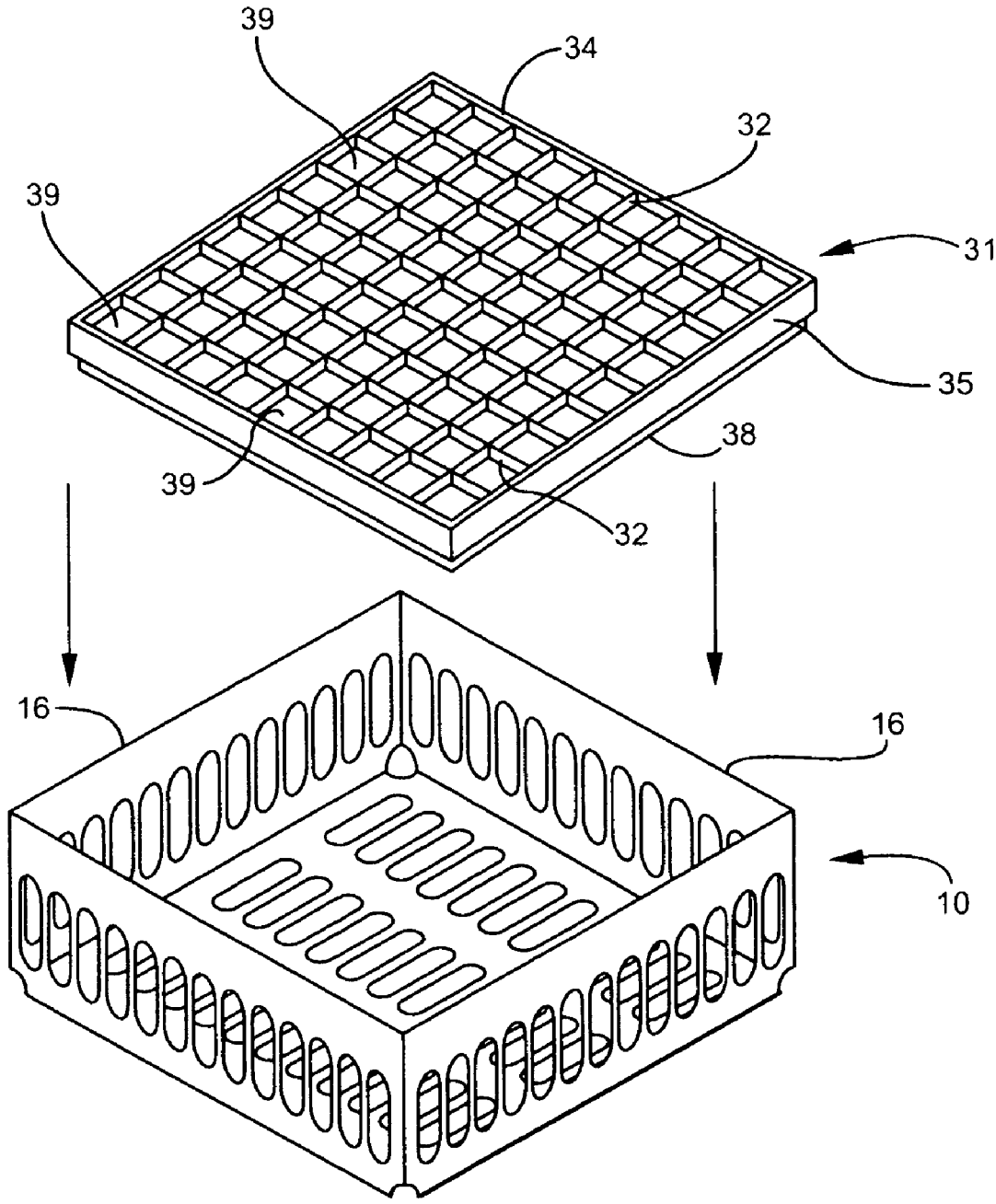
FIG. 4 is a perspective view of an alternative embodiment of the containment apparatus.

Turning to FIG. 4, the apparatus is shown with an alternative type of divider 31. The alternative divider 31 is comprised of any suitable material or combination including, but not limited to, those discussed herein, including, as in this embodiment, a molded material such as a thin plastic. The divider 31 has a top surface 34, a bottom surface 38, an outer edge 35, with a series of transverse borders 32, which define a plurality of aligned wells 39 within the outer edge 35. The divider 31 can be of any suitable dimensions may be used providing that the divider 31 has dimensions that would allow for placement of vials within the divider and placement of the divider within the containment apparatus 10.

In this embodiment, the divider rests on the walls 16 of the apparatus 10. It can simply rest on the walls 16 if this is sufficient or be secured by any suitable means in the art. Further, the divider 31 can have a groove (not shown) along the bottom surface such that the divider 31 can snap onto the apparatus 10 or be otherwise structurally secured.

Figure 5:
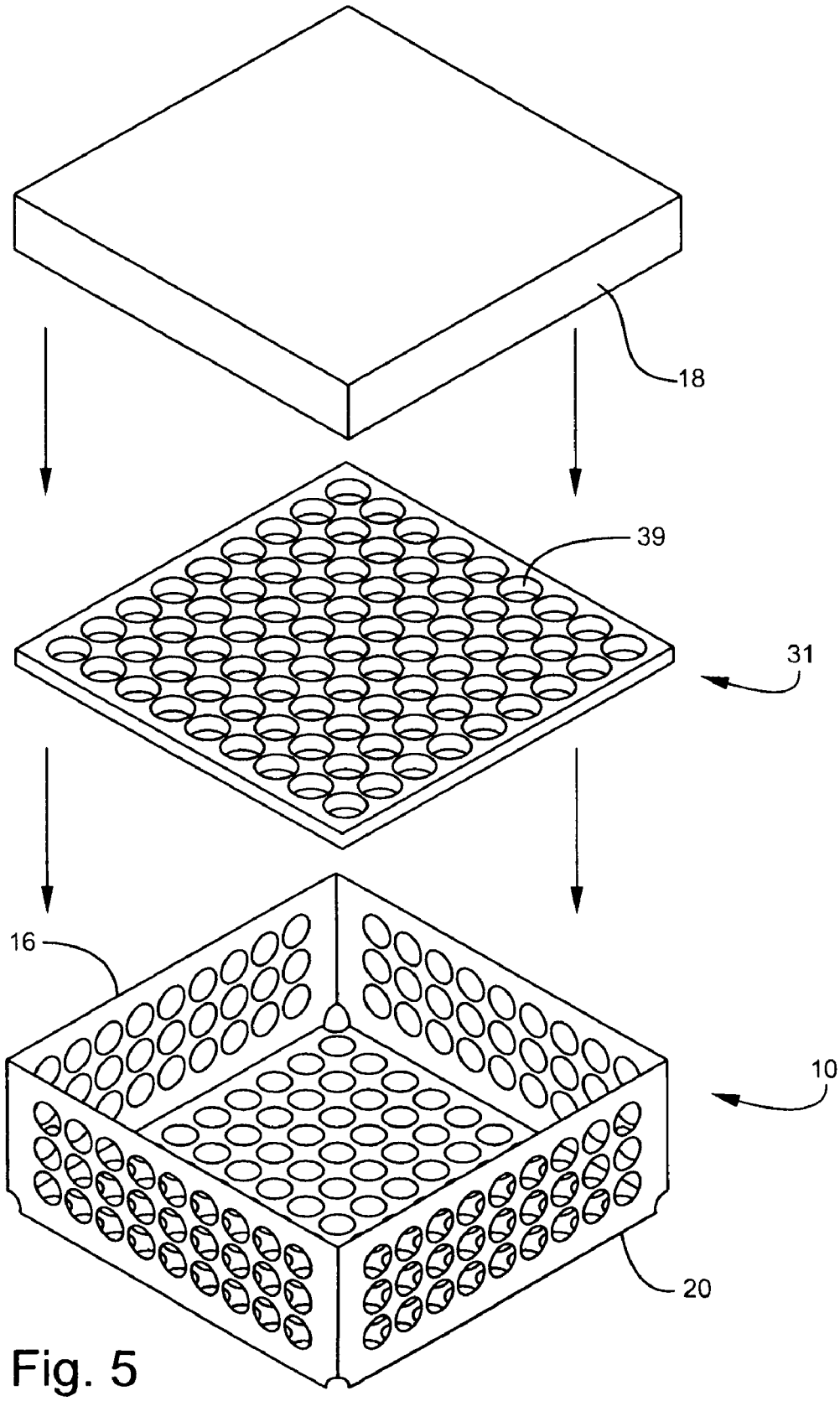
FIG. 5 is a perspective view of an alternative embodiment of the containment apparatus.

Turning to FIG. 5, another alternative embodiment of the containment apparatus 10 is shown. In this embodiment, the apertures 20 of the apparatus are circular and another alternative divider 31 is shown. The alternative divider herein has wells 39 that are cylindrically shaped. The divider 31, as shown previously herein, is placed within the containment apparatus 10. A lid 18 is shown again being placed over the apparatus 10.

As previously mentioned, existing racks or other means for use in controlled rate freezers 42 are of a non-industry standard configuration unsuitable for use in cryogenic storage freezers 54 and storage containers used in cryogenic storage are unsuitable for controlled rate freezing. The invention herein provides a containment apparatus of industry standard cryogenic configuration, which allows for free air flow around and between thermosensitive product vials for successful controlled rate freezing. The containment apparatus also provides sufficient protection of samples during cryogenic storage. The containment apparatus 10 is capable of reducing the possibility of vial misplacement, and will save valuable time and labor costs by eliminating the steps of moving and tracking a plurality of thermosensitive product vials.

Accordingly, this device can facilitate controlled rate freezing, with its advantages, for important products such as tissue, DNA specimens, cells of all types, embryos, nucleic acids, bacteria, etc, decreased in temperature at a preprogrammed, controlled rate then stored and subsequently cryoprotected with access for later use.

Figure 6:
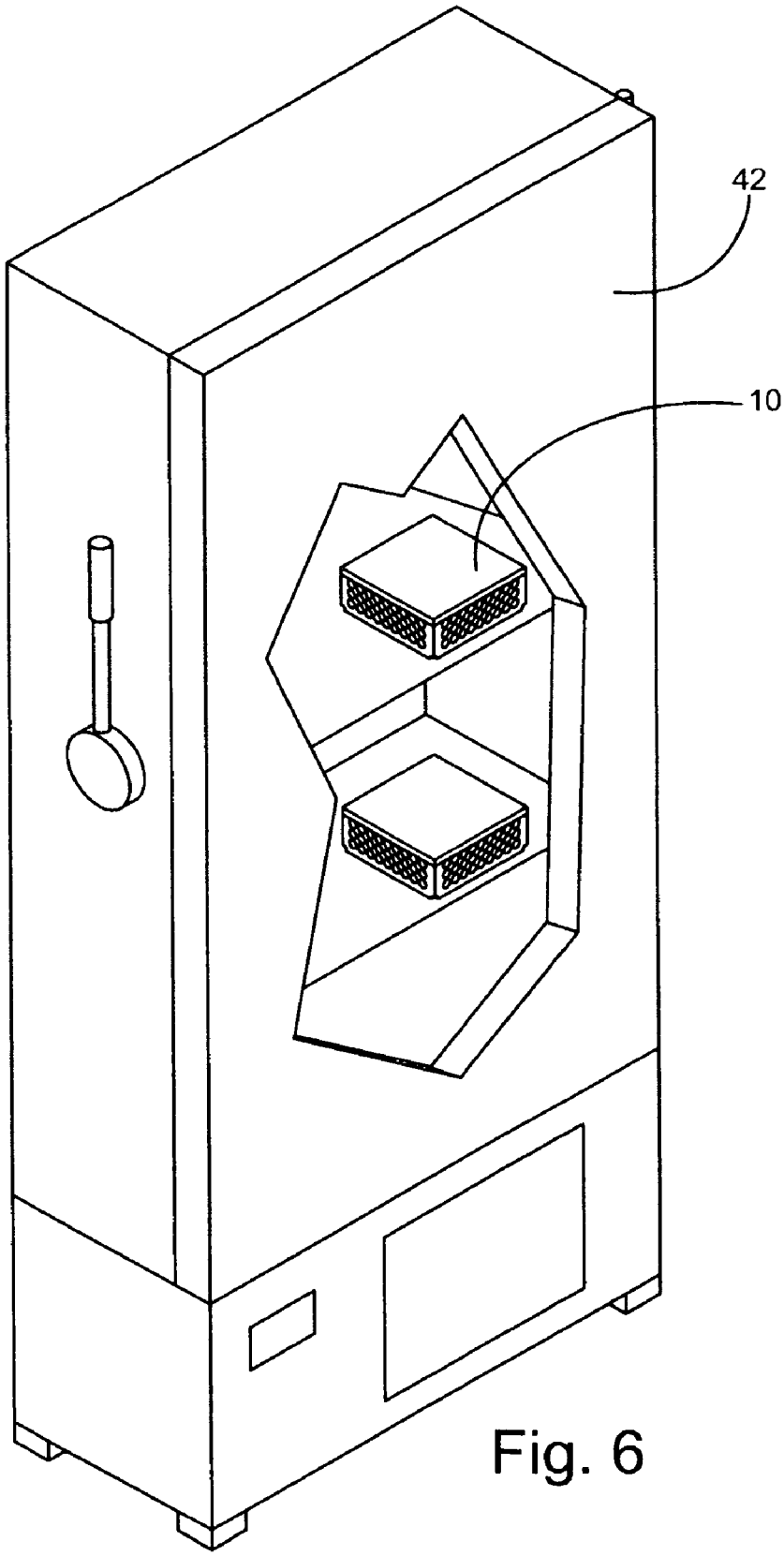
FIG. 6 is an environmental view of the containment apparatus inside a controlled rate freezer.
Figure 7:
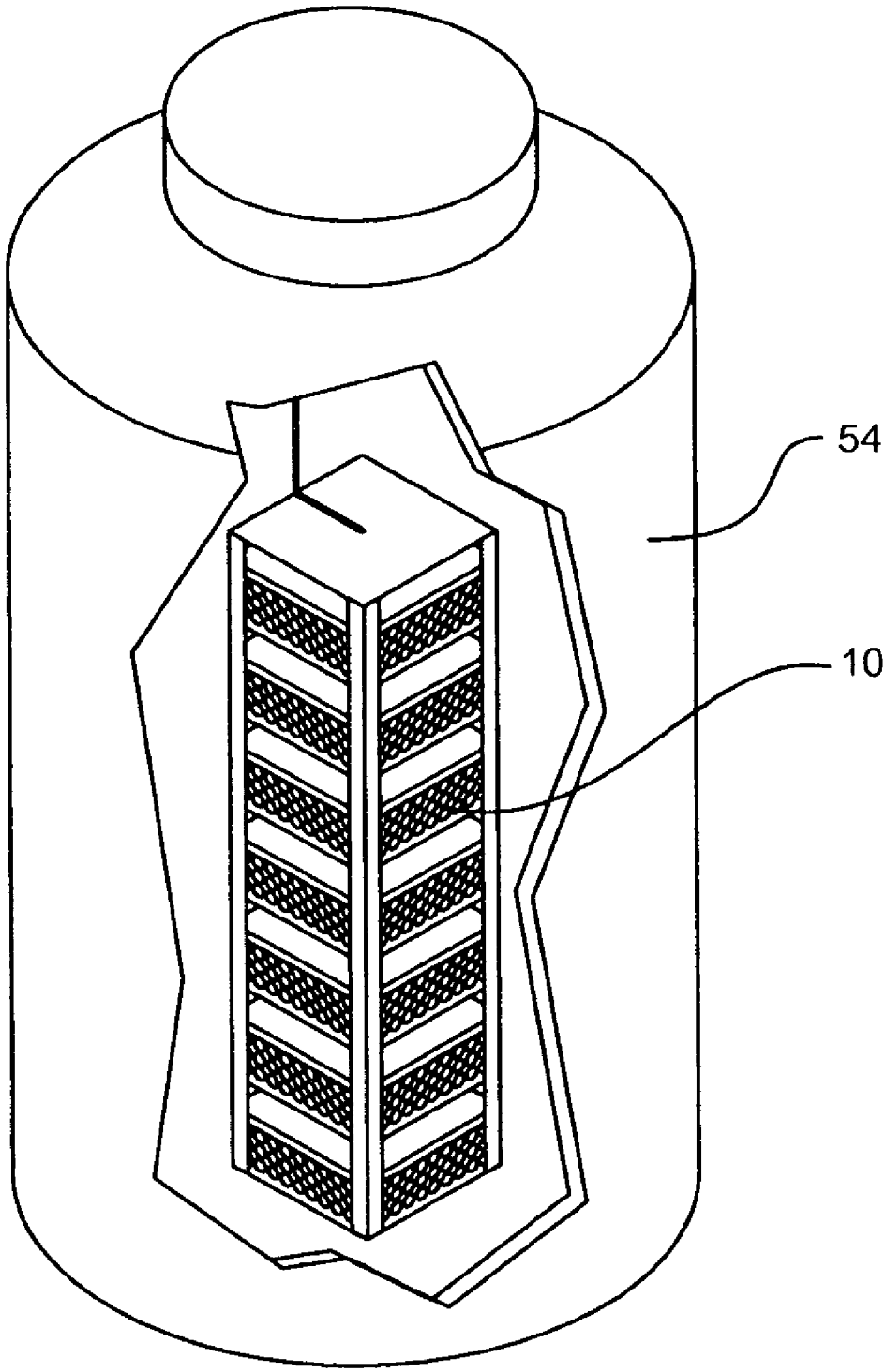
FIG. 7 is an environmental view of the containment apparatus inside a cryogenic storage freezer.

In addition to the containment apparatus, the invention claimed also includes a method for controlled rate freezing and subsequent cryogenic storage. This method involves placing the thermosensitive product vials in the containment apparatus 10, placing the apparatus in the controlled rate freezer 42, as in FIG. 6, then removing from the controlled rate freezer 42 and placing directly in the cryogenic storage freezer 54, as in FIG. 7. This method eliminates the steps of first, placing the thermosensitive product vials in a non-industry standard container for controlled rate freezing and second, having to remove and arrange them in proper order in an industry standard container for storage in the cryogenic freezer.

CONCLUSIONS, RAMIFICATIONS, AND SCOPE

As will be clear to those of skill in the art, the present invention is suitable for use in controlled rate freezing, cryogenic freezing, storage and thawing of thermosensitive products.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention.

DRAWINGS—REFERENCE NUMERALS

10 Containment Apparatus
12 Floor Wall
13 Opening
16 Side wall
18 Lid
20 Apertures
21 Divider
22 Divider apertures
23 Interlocking wall strip
25 Compartment
31 Alternative Divider
32 Borders
34 Top Surface
35 Outer Edge
38 Bottom Surface
39 Well

What is claimed is:

1. A method for controlled rate freezing and subsequent cryogenic storage of thermosensitive products comprising the steps of:

a) providing a multipurpose containment apparatus, comprising:

a substantially square or rectangular floor wall having multiple apertures defined therein;

four side walls extending substantially perpendicularly from said floor wall, wherein each of the respective side walls have multiple apertures defined therein, and wherein each of the respective side walls terminates at a top end; and means for positioning and separating said plurality of thermosensitive product vials within the containment apparatus;

wherein the apparatus is capable of providing substantially free airflow throughout, resulting in a more uniform temperature reduction during the controlled rate freezing process; and b) placing said product vials within said positioning and separating means;

c) placing said containment apparatus in a controlled rate freezer;

d) freezing said thermosensitive products vials by bringing down the temperature gradually whereby reducing shock to the thermosensitive products contained within said product vials;

e) removing said containment apparatus from said controlled rate freezer; and f) placing said containment apparatus directly into a cryogenic storage freezer whereby reducing the risk of vial misplacement and harm to specimens.

2. A method for controlled rate freezing and subsequent cryogenic storage of thermosensitive products as in claim 1, wherein the containment apparatus further comprises; a removable lid capable of fitting upon the top ends of the side walls.

3. A method for controlled rate freezing and subsequent cryogenic storage of thermosensitive products as in claim 1 wherein said means for positioning and separating the thermosensitive product vials of the containment apparatus further comprises:

a divider, said divider comprising a plurality of interlocking wall strips transversely connected to define a plurality of smaller compartments, said wall strips having multiple apertures defined therein, wherein the divider is capable of providing substantially free airflow throughout said divider.

4. A method for controlled rate freezing and subsequent cryogenic storage of thermosensitive products as in claim 1 wherein said means for positioning and separating the thermosensitive product vials of the containment apparatus further comprises:

a divider, said divider comprising a plurality of wells defined therein for receiving thermosensitive product vials for positioning and separating said vials within the containment apparatus; and means for securing the divider to the side walls, the floor wall, or both.

5. A method for controlled rate freezing and subsequent cryogenic storage of thermosensitive products comprising the steps of:

a) providing a multipurpose containment apparatus, comprising:

a substantially square or rectangular floor wall having multiple apertures defined therein;

four side walls extending substantially perpendicularly from said floor wall, wherein each of the respective side walls have multiple apertures defined therein, and wherein each of the respective side walls terminates at a top end;

a removable lid capable of fitting upon the top ends of the side walls;

a divider for positioning and separating said thermosensitive product vials, said divider comprising a plurality of interlocking wall strips transversely connected to define a plurality of smaller compartments, said wall strips having multiple apertures defined therein;

wherein the apparatus is capable of providing substantially free airflow throughout, resulting in a more uniform temperature reduction during the controlled rate freezing process, and b) placing said product vials within said positioning and separating means;

c) placing said containment apparatus in a controlled rate freezer;

d) freezing said thermosensitive products vials by bringing down the temperature gradually whereby reducing shock to the thermosensitive products contained within said product vials;

e) removing said containment apparatus from said controlled rate freezer; and f) placing said containment apparatus directly into a cryogenic storage freezer whereby reducing the risk of vial misplacement and harm to specimens.

6. A method for controlled rate freezing and subsequent cryogenic storage of thermosensitive products comprising the steps of:

a) providing a multipurpose containment apparatus, comprising:

a substantially square or rectangular floor wall having multiple apertures defined therein;

four side walls extending substantially perpendicularly from said floor wall, wherein each of the respective side walls have multiple apertures defined therein, and wherein each of the respective side walls terminates at a top end;

a removable lid capable of fitting upon the top ends of the side walls;

a divider for both positioning and separating said plurality of thermosensitive product vials within the containment apparatus, said divider comprising a plurality of wells defined therein for receiving thermosensitive product vials for positioning and separating said vials within the containment apparatus; and means for securing the divider to the side walls, the floor wall;

wherein the apparatus is capable of providing substantially free airflow throughout, resulting in a more uniform temperature reduction during the controlled rate freezing process, and b) placing said product vials within said positioning and separating means;

c) placing said containment apparatus in a controlled rate freezer;

d) freezing said thermosensitive products vials by bringing down the temperature gradually whereby reducing shock to the thermosensitive products contained within said product vials;

e) removing said containment apparatus from said controlled rate freezer; and f) placing said containment apparatus directly into a cryogenic storage freezer whereby reducing the risk of vial misplacement and harm to specimens.

* * * * *